US005101578A

United States Patent [19]

Swanson

[11] Patent Number: 5,101,578

[45] Date of Patent: Apr. 7, 1992

[54] SYSTEM AND PROCESS FOR DRYING A MOVING SHEET

[75] Inventor: David Swanson, Pleasanton, Calif.

[73] Assignee: Measurex Corporation, Cupertino, Calif.

[21] Appl. No.: 574,574

[22] Filed: Aug. 24, 1990

Related U.S. Application Data

[63] Continuation of Ser. No. 300,502, Jan. 23, 1989, abandoned.

[51] Int. Cl.[5] ..... F26B 13/00

[52] U.S. Cl. ..... 34/152; 34/41; 34/39; 34/4

[58] Field of Search ..... 34/4, 41, 39, 1, 152; 219/343, 354

[56] References Cited

U.S. PATENT DOCUMENTS 3,151,950 10/1964 Newman et al. ..... 34/41 X
3,894,343 7/1975 Pray et al. ..... 34/41
4,169,007 9/1979 Pray ..... 34/4
4,513,516 4/1985 Bjornberg ..... 34/41
4,594,795 6/1986 Stephansen ..... 34/4 X
4,626,659 12/1986 Charmes et al. ..... 219/343

*Primary Examiner*—Albert J. Makay
*Assistant Examiner*—John Sollecito
*Attorney, Agent, or Firm*—Hal J. Bohner

[57] ABSTRACT

A system for drying a moving sheet includes a housing, support means connected to the housing to support heater bulbs adjacent to moving sheet and a power supply connected to the bulbs. The heater bulbs are located so that at least part of the radiation from each of the bulbs travels directly to the sheet without passing through another bulb while from a plurality of bulbs part of the radiation travels in a straight line to the sheet and before reaching the sheet the radiation passes between two other bulbs without passing through another bulb.

6 Claims, 4 Drawing Sheets

SYSTEM AND PROCESS FOR DRYING A MOVING SHEET

This is a continuation of co-pending application Ser. No. 07/300,502 filed on Jan. 23, 1989 now abandoned.

BACKGROUND OF THE INVENTION

The present invention relates to apparatus for drying a moving sheet and more particularly to the use of infrared dryer bulbs located across the moving sheet which may be individually controlled to provide a uniform moisture profile.

STATE OF THE ART

In the paper making process in which a continuously moving sheet of paper is being produced, it has been known that drying, which is normally accomplished by cylindrical steam drums, can be uneven across the sheet. Such an uneven condition is sometimes called streaking. There are known devices to correct the variation of moisture across the sheet, and control systems for accomplishing this objective are known.

One example of such a system is taught in U.S. Pat. No. 4,494,316 to Stephansen et al. Stephansen et al teach an apparatus including a support structure arranged transversely across the sheet, and forming the main structural support for the drying apparatus. The support structure receives a plurality of dryer of modules in side-by-side relationship adjacent the sheet. A plurality of quartz lamp heaters in the form of infrared tubes or bulbs are mounted in the dryer modules. Selective application of electrical power to the quartz lamp heaters permits control of the moisture profile.

In the system taught by Stephansen, all of the quartz lamp heaters are located in single plane spaced apart from the moving sheet. Such a configuration of heaters is common in the art.

I have found, however, that an alternative arrangement of the quartz lamps permits substantial improvement in the rate at which energy can be transmitted into the sheet thereby providing for more accurate and effective control of moisture streaks.

OBJECT OF THE INVENTION

Thus it is an object of the invention to provide an improved apparatus for controlling the moisture profile of a moving sheet.

DESCRIPTION OF THE PREFERRED EMBODIMENT

Figure 1:
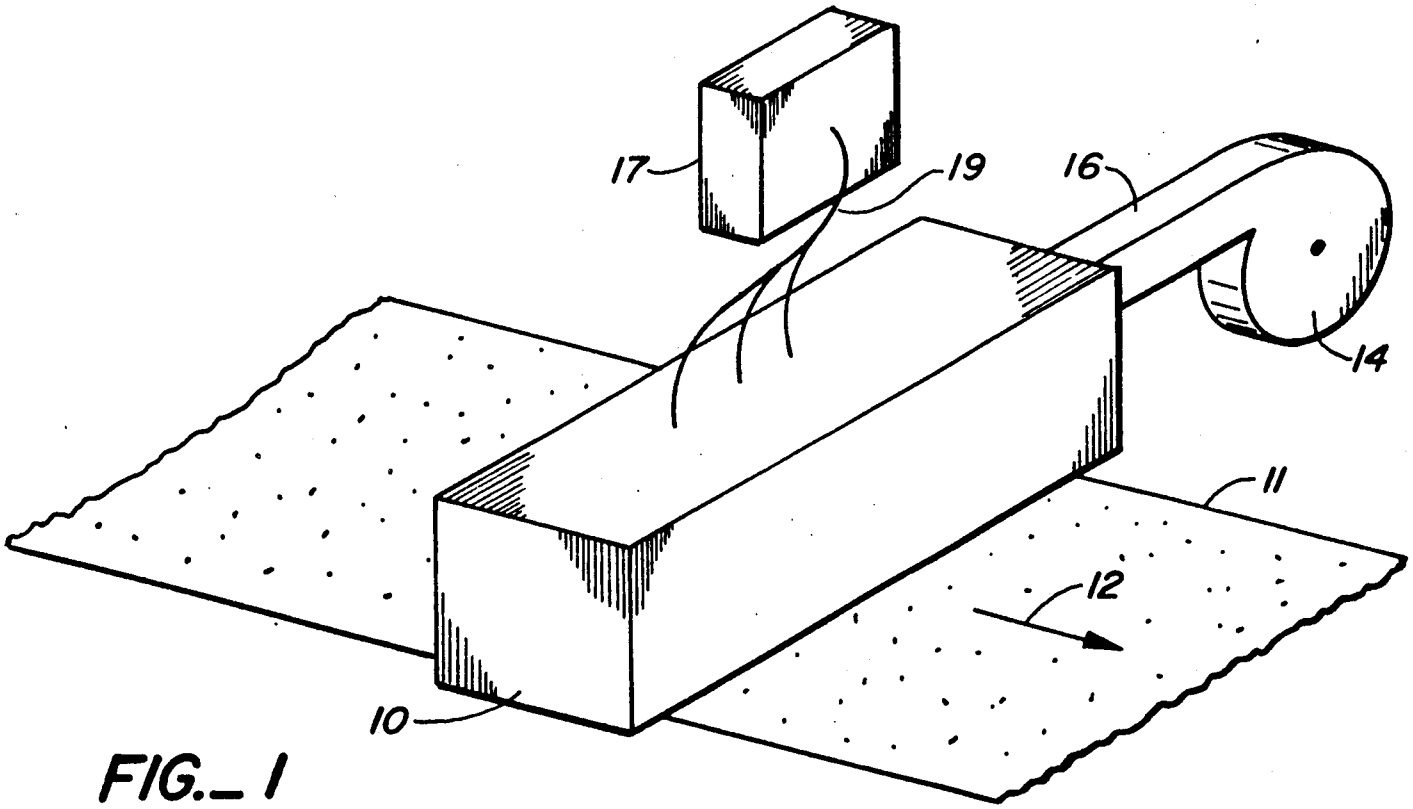
FIG. 1 is a perspective view of apparatus embodying the present invention.

FIG. 1 shows drying apparatus 10 which is located transverse or in the cross-direction to the sheet of paper 11, which is moving in the direction indicated by arrow 12. In the position shown, the drying apparatus 10 is in close proximity to the moving sheet 11. A forced air blower 14 is coupled to the end of the drying apparatus 10 by conduit 16 to provide pressurized ambient air for cooling. Power supply 17 is coupled to receive electrical power e.g. from a 220 volt supply and to controllably supply D.C. electrical power to the drying apparatus 10 by wiring 19.

Figure 2:
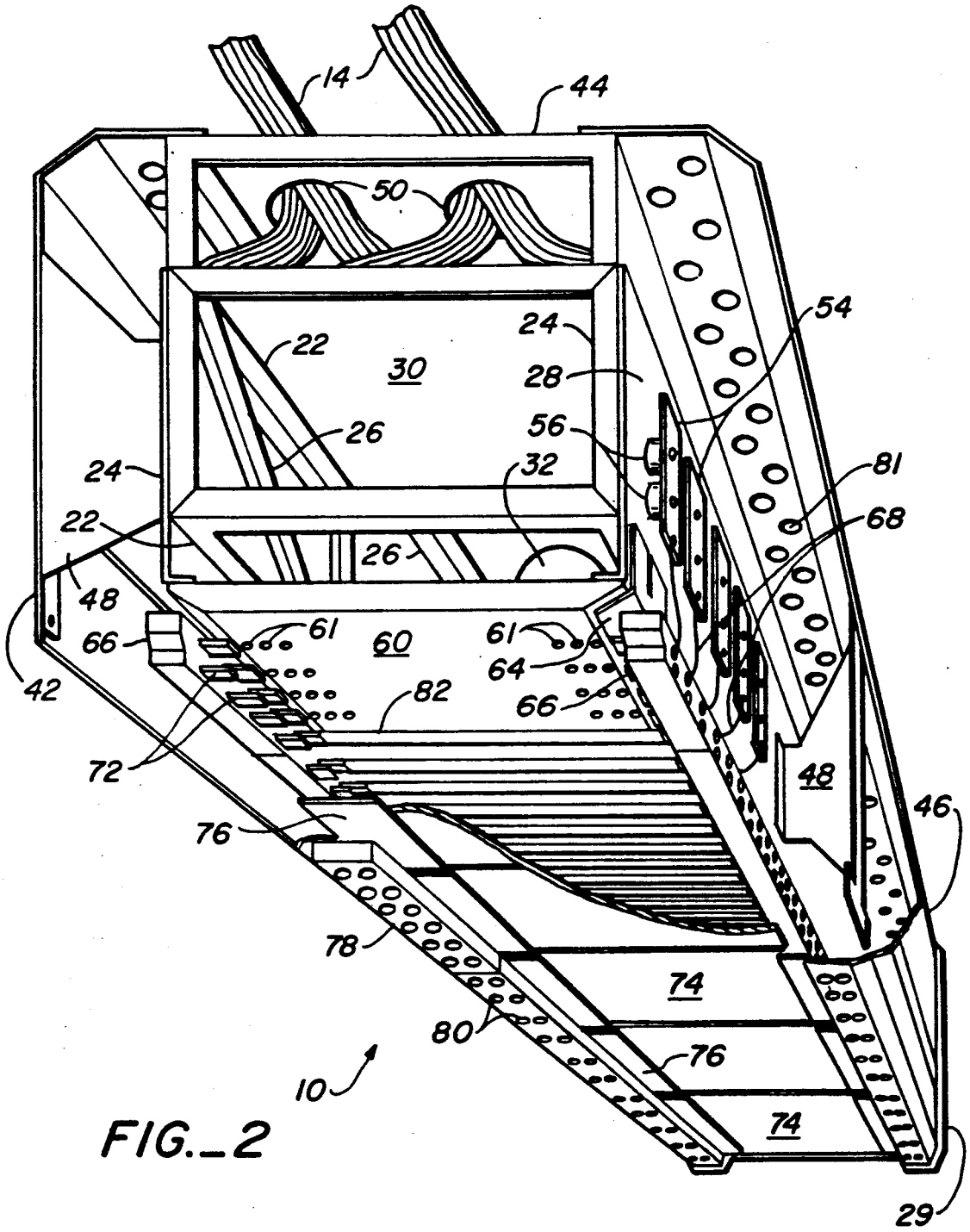
FIG. 2 is a partially cut away view of one component of the apparatus shown in FIG. 1.

Turning now to FIG. 2, the drying apparatus 10 is showed in detail. The drying apparatus 10 includes a support structure 20 comprised of four L-shaped beams 22 horizontally disposed across the sheet of paper and parallel thereto. The horizontal L-shaped beams 22 are connected together at their ends by four L-shaped beams 24 which are disposed perpendicular to the sheet of paper. The L-shaped beams 22 and 24 form a rectangular box-like structure. Additional L-shaped beams 26 are added to the structure to enhance structural integrity. The L-shaped beams are coupled to suitable support structure, not shown, to retain the drying apparatus in the position shown in FIG. 1 during normal operation.

Inner plenum walls 28 are sealed to the four sides of the box formed by the L-shaped beams and two end walls 29 are affixed to the ends of the box to provide a inner plenum 30 to contain air under pressure from the forced air blower 14. A plurality of circular cooling air ports 32 are formed in the inner plenum wall 28 which is located on the bottom of the plenum to allow the escape of cooling air from the inner plenum 30.

An outer plenum 40 is located surrounding the inner plenum 30. The outer plenum 40 is formed primarily by three outer plenum walls 42, 44 and 46 each of which is located parallel to one of the walls of the inner plenum 30 and spaced apart therefrom by spacer brackets 48. A plurality of ports 50 are formed in the outer plenum wall 44 to permit wiring 19 to be connected between power supply 17, and the electrical components of the device as will be discussed hereafter. The wiring 19 enters the device through ports 50 and is run through the device in the space between the outer plenum wall 44 and the adjacent inner plenum wall.

The wiring 19 runs to a plurality of zone power bus bars 54 which are connected to one of the walls of the inner plenum by ceramic insulator standoffs 56.

Adjacent the bottom of the inner plenum 30 there are mounted a plurality of reflectors 60 which are constructed of material such ceramic alumina sold under the trademark Zircar. The reflectors 60 are substantially rectangular in configuration and are mounted to the inner plenum walls 28 by brackets 62. A plurality of holes 61 are formed in the reflectors 60 to permit the passage of air. To each reflector 60 there are mounted holder brackets 64 which extend the length of the device and are mounted to the plenum walls adjacent the ends of the brackets 62.

A plurality of lamp holders 66 are mounted to the holder brackets 64. The lamp holders 66 are constructed of an insulating material such as ceramic and receive power wiring 68 extending from the bus bars 54 through ports 70 formed in their edges. The wiring 68 extends through the ceramic lamp holders 66 and terminates in power buses 72 which extend a short distance from the ceramic lamp holder 66.

A plurality of quartz plates 74 are located parallel to lower faces of the reflectors 60 and spaced apart therefrom. The quartz plates 74 are mounted in channels formed in two lower walls 78 which are connected to the sides of the outer plenum chamber 42 and 46. Optionally, the lower walls 78 can include a plurality of ports 80.

A plurality of infrared lamps 82 are connected between the buses 72 and located spaced apart from the reflector 60 and also spaced apart from the quartz plate 74.

A plurality of cooling nozzle ports 61 are located in the ends of the reflectors 60.

Figure 3:
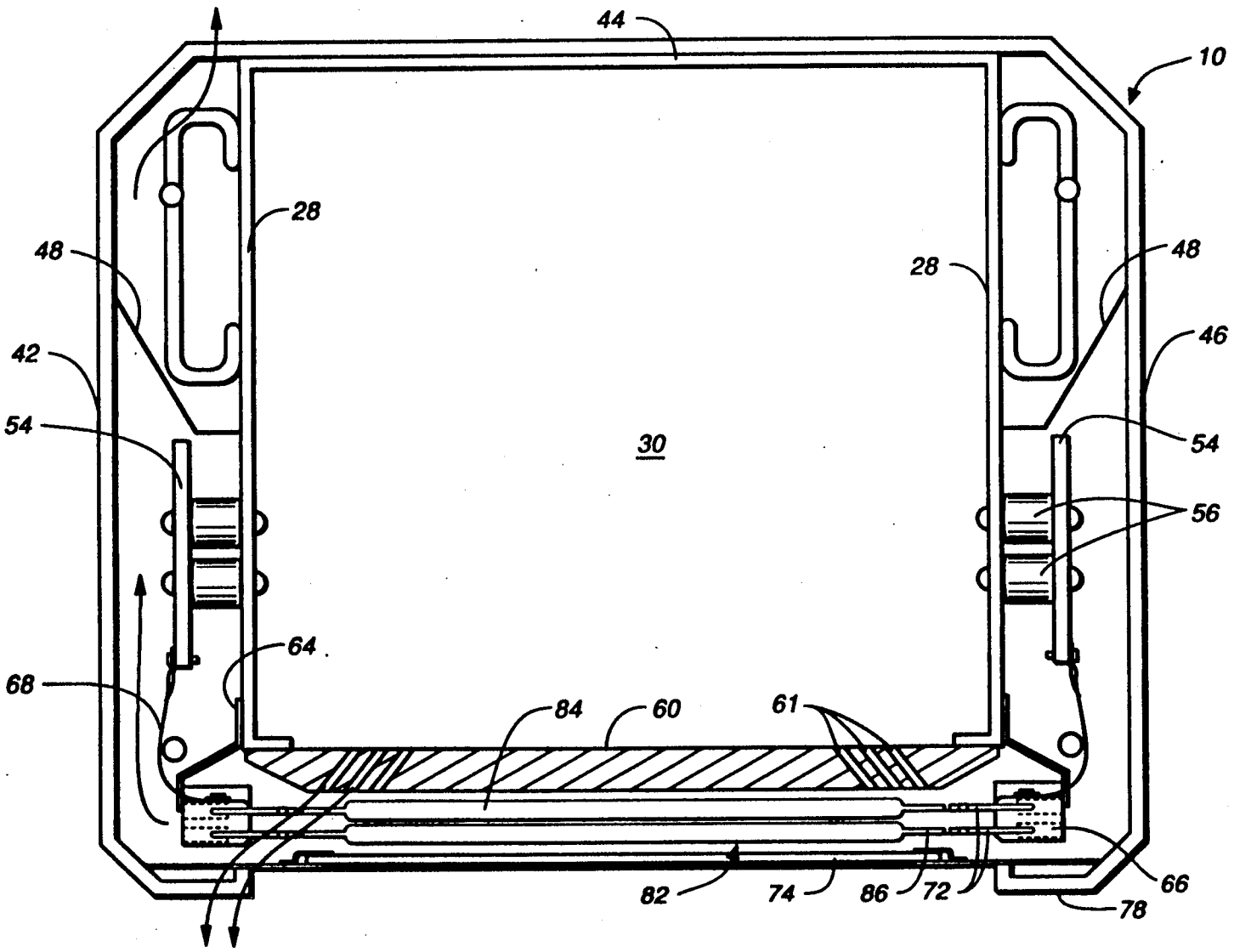
FIG. 3 is a cross-sectional view of the device shown in FIG. 2.

Turning now to FIG. 3, a portion of the system is shown in cross section. Infrared lamps 82 are located between the reflectors 60 and quartz plates 74. The infrared lamps 82 are long and cylindrical having their axes located parallel to the sheet of paper. Two rows of infrared lamps 82 are shown in FIG. 3 with the axes of the lamps in the first row located in a plane spaced apart from the sheet and the axes of the second row forming a plane which is spaced farther apart from the sheet than the plane of the first lamps 82. The lamps 82 can be purchased from various vendors such as Phillips Corporation and include an emitter element 84 is located in the cylindrical portions. The ends of the lamps 82 are pinched as shown by number 86, and the emitters terminate at the pinched ends 8 in metal connectors 88. When the infrared lamps 82 are installed in the device their metal connectors 88 are bolted to corresponding power buses 72

The present device includes means to cool the infrared lamps 82. Holes 61 are formed in the ends of the reflectors 60 to permit air to flow from the inner plenum 30 toward the pinched ends 86 of the lamps 82 as indicated by the arrows. The air then travels in different directions depending upon the configuration of the system. If ports 80 are formed in the lower wall 78, the air flows past the pinched ends 86 and then out of the device through the ports 80 and toward the sheet 11. On the other hand, if there are no ports 80, and the lower wall 78 is solid, a plurality of upper ports 81 are formed in the upper outer plenum wall 46 and the air flows past the pinched ends 86 and then upward between the walls of the inner and outer plenums 30 and 40 and then out ports 81. As another alternative the device can include both upper ports 80 and lower ports 81, in which case part of the cooling air is exhausted through each set of ports. In a paper mill the atmosphere above the paper machine is normally quite humid. The flow of air past the pinched ends 86 heats the air significantly, and the hot air traveling upward between the inner plenum 30 and outer plenum 40 can heat the outer plenum 40. Thus any possible condensation on the exterior of the outer plenum is reduced or eliminated.

It should be noted that the holes 61 are located with their axes not perpendicular to the faces of the reflector 60. Rather, the axes of the holes 61 are oriented so that air blowing from the holes 61 is directed away from the central section of the lamps 82. Thus cooling air is not directed to travel over the portion of lamps 82 which house the emitters 84. Rather, cooling of such portions of the lamps is accomplished primarily by the flow of heat through the quartz tube to the pinched ends 86 and thence to be remove by cooling air traveling around the pinched ends.

It should be recognized that this structure for cooling the lamps 82 permits the emitter portion 84 of the lamps to operate at relatively high temperatures, e.g. about 900 degrees C. (which provides maximum efficiency and bulb life) while maintaining the pinched ends of the lamps below their maximum operating temperatures which in some cases is about 300 degrees C.

Figure 4:
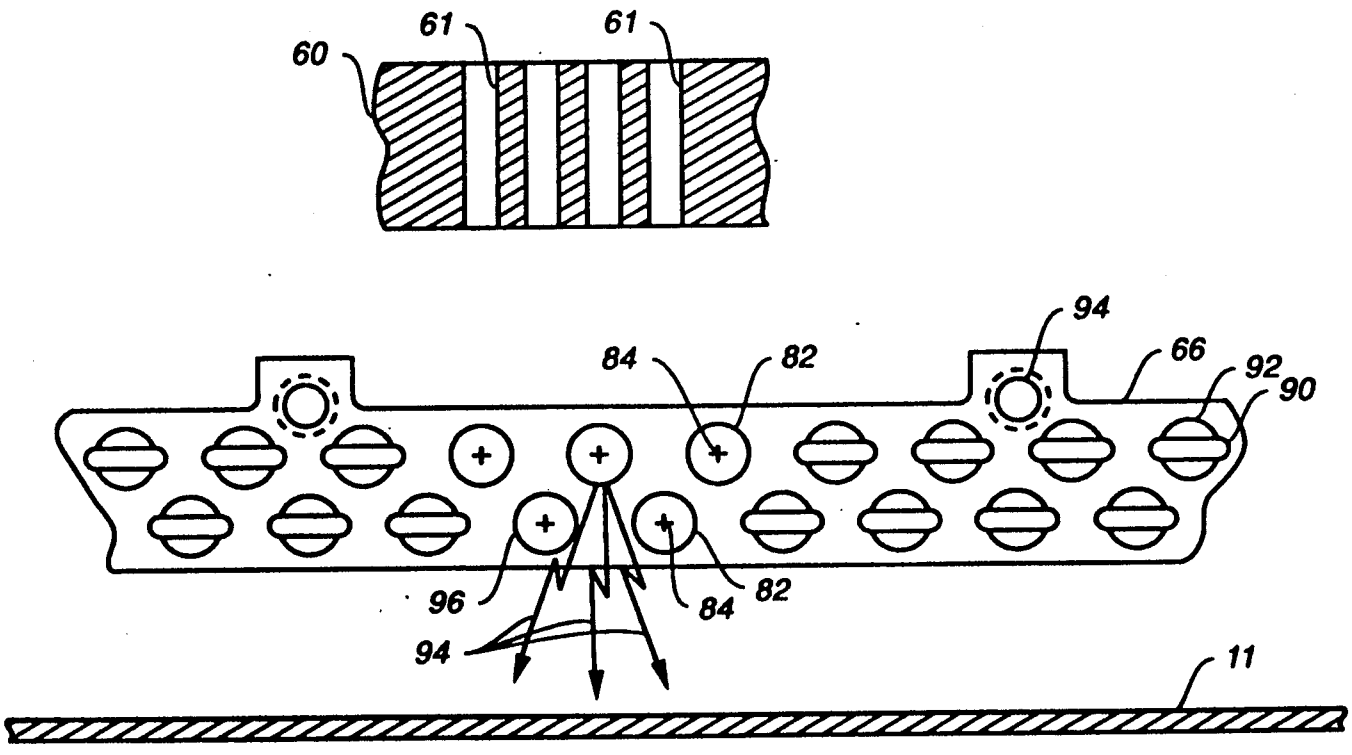
FIG. 4 is a detail of the device shown in FIG. 3 taken along line 4—4.

Turning to FIG. 4 it can be seen that associated with each lamp 82 there are holes 61. The center lines of at least two the holes 61 are aligned with the center line 84 of each lamp 82 so that cooling air flows directly from at least one hole 61 to the end of each lamp 82. I have found that preferably two holes are associated with each lamp 82 in the upper row of lamps while four holes are associated with each lamp 82 of the lower row of lamps. As best shown in FIG. 2, two holes direct cooling air at each end of each lamp 82 in the lower row while one hole directs cooling air toward each end of each lamp in the upper row. In some situations it may be preferable to use different hole configurations; however I believe that in practice it normally is preferable to use more hole area to provide cooling air to the lower lamps than for the upper lamps. The lamps 82 are spaced apart from one another to allow substantial quantities of cooling air to reach the lamps in the lower row.

Referring still to FIG. 4, one of the lamp holders 66 is shown in detail. For the purpose of illustration some bulbs are shown installed. It should be noted that the diameter of the bulbs are less than the distance between their center lines. A plurality of generally rectangular ports 90 are formed part way through the holder 66, and cylindrical ports 92 are drilled from the other side of the holder 66 to provide communication with the rectangular ports 90. As best shown in FIG. 2 the cylindrical ports 92 receive wiring 68, and power buses 72 are mounted in ports 90. A plurality of mounting holes 94 ar formed in the holder to accommodate bolts to bolt the holder to the bracket. It can now be seen that the infrared bulbs are supported in the drying apparatus 10 so that some bulbs are located farther from the sheet than other bulbs and at least part of the radiation from each of the bulbs can travel directly to the sheet without passing through another bulb. Also it can be seen that the bulbs are located in two planes which are spaced apart from the sheet different distances.

Infrared lamps 82 are shown in cross section, and the center lines of the bulbs 82 are indicated by small crosses 84. Thus it can be seen that the center lines 84 of the upper row of bulbs 82 all lie in a single plane while the center lines 84 of the lower row of bulbs all lie in a different plane. Furthermore, it can be seen that the sheet 11 is spaced apart from the two planes by different distances. Rays of infrared radiation 94 are schematically illustrated emanating from one of the infrared lamps 82. As can be seen, some of the infrared radiation passes from the lamp directly to the sheet of paper 11 without passing through any other lamp; whereas some of the radiation passes through second lamp 96.

By locating the lamps in this configuration I have found it possible to create a higher power density than in prior art systems in which the center lines of all the lamps were located in the same plane. For example, in one device which has been constructed according to my invention, I have found it possible to obtain a power density of about 64 kilowatts per square foot as contrasted to comparable systems having bulbs in a single plane which have a power density of about 40 kilowatts per square foot.

What is claimed is:

1. A system for drying a moving sheet comprising:

a) a housing;

b) bulb support means affixed to the housing to support a plurality of heater bulbs adjacent the moving sheet, the bulb support means being constructed and arranged so that at least part of the radiation from each of the bulbs travels directly to the sheet without passing through another bulb while from a plurality of bulbs part of the radiation travels in a straight line to the sheet and before reaching the sheet the radiation passes between two other bulbs without passing through another bulb;

c) a plurality of heater bulbs affixed to said support means; and, d) means to supply power to the bulbs.

2. A system for drying a moving sheet comprising:

a) a housing;

b) bulb support means affixed to the housing to support a plurality of heater bulbs near the moving sheet, the bulb support means being constructed and arranged so that:

(i) a plurality of the bulbs are located in a first plane;

(ii) a plurality of bulbs are located in a second plane;

(iii) the first and second planes are located to the same side of the sheet;

(iv) the two planes are spaced apart from the sheet different distances; and, (v) if third and fourth planes are constructed perpendicular to the first plane and through the centerlines of two bulbs in the first plane, one bulb in the second plane lies between the third and the fourth plane;

c) a plurality of heater bulbs affixed to said support means; and d) means to supply power to the bulbs.

3. A system according to claim 1 or 2 further including means to cool the heater bulbs.

4. A system according to claim 3 wherein the means to cool the heater bulbs includes means to supply streams of air directed toward the ends of the bulbs.

5. A system according to claim 1 or 2 further including:

a) a reflector spaced apart from the bulbs;

b) holes formed in the reflector to direct streams of cooling air toward the ends of the bulbs;

c) means to provide pressurized air through the holds formed in the reflector.

6. A system according to claim 5 wherein the holes are oriented so that the streams of cooling air flow toward the ends of the bulbs and away from the centers of the bulbs in order that the ends of the bulbs are cooled while maintaining the centers of the bulbs at relatively higher temperatures.

* * * * *

UNITED STATES PATENT AND TRADEMARK OFFICE

CERTIFICATE OF CORRECTION

PATENT NO. : 5,101,578

DATED :March 31, 1992

INVENTOR(S) :Fu et al

It is certified that error appears in the above-identified patent and that said Letters Patent is hereby corrected as shown below:

Column 55, line 27, delete "include" and insert -- included --.

Column 56, line 10, after "output", insert --means --.

Signed and Sealed this

Twenty-second Day of June, 1993

*Attest:*

Michael K. Kirk

MICHAEL K. KIRK

*Attesting Officer*

*Acting Commissioner of Patents and Trademarks*